United States Patent [19]

Artusi

[11] Patent Number: 4,801,017

[45] Date of Patent: Jan. 31, 1989

[54] CONTAINER, PARTICULARLY FOR RECEIVING FOODS

[76] Inventor: Aldo Artusi, Muhleboden 661, CH-8461 Trullikon, Switzerland

[21] Appl. No.: 180,966

[22] Filed: Apr. 13, 1988

Related U.S. Application Data

[63] Continuation of Ser. No. 924,838, Oct. 17, 1986, abandoned.

[51] Int. Cl.[4] ..... B65D 90/04

[52] U.S. Cl. ..... 206/524.1; 219/10.55 E; 220/410; 220/405

[58] Field of Search ..... 206/514, 524.1, 525; 229/43; 220/405, 406, 410; 219/10.55 E

[56] References Cited

U.S. PATENT DOCUMENTS

| | | | |
|---|---|---|---|
| 2,391,767 | 12/1945 | Beerend | 220/410 |
| 3,104,012 | 9/1963 | Beamish | 206/525 |
| 3,155,304 | 11/1964 | Beerend | 220/405 |
| 3,738,730 | 2/1976 | Detzel et al. | 206/557 |
| 4,304,352 | 12/1981 | Humphries | 229/43 |
| 4,463,893 | 8/1984 | Brunone et al. | 229/43 |

FOREIGN PATENT DOCUMENTS

| | | | |
|---|---|---|---|
| 0012026 | 6/1980 | European Pat. Off. . | |
| 0039939 | 11/1981 | European Pat. Off. . | |
| 2051643 | 4/1971 | France . | |
| 2141254 | 1/1973 | France . | |
| 2127677 | 4/1984 | United Kingdom | 206/557 |
| 8600275 | 1/1986 | World Int. Prop. O. | 206/557 |

*Primary Examiner*—Joseph Man-Fu Moy
*Attorney, Agent, or Firm*—Bachman & LaPointe

[57] ABSTRACT

In a container, particularly for receiving foods or the like, a tray is to be shaped from at least one heat-resistant plastic layer. This tray (2) is surrounded by a blank (1) and the latter is at least partly joined to the tray (2).

15 Claims, 3 Drawing Sheets

CONTAINER, PARTICULARLY FOR RECEIVING FOODS

Figure 1:
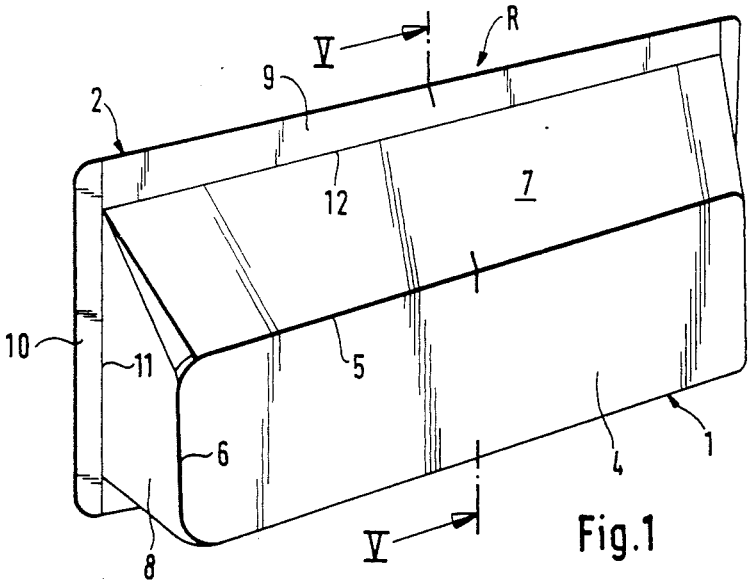

This is a continuation of application Ser. No. 924,838 filed Oct. 17, 1986, now abandoned.

The invention relates to a container, particularly for receiving foods and the like, with a tray made from at least one heat-resistant plastic layer.

Such a tray is known from European Patent No. 12 026, where the heat-resistant plastic layer is a layer of a composite material comprising at least one further layer of a heat-resistant material which is not modified by the radiation as a carrier or support structure for the plastic layer. This container has the important advantage that it can be placed in an oven together with its content, without the internal plastic coating melting or the content sticking to the internal plastic coating. However, the manufacture of a container from such a composite material leads to difficulties, if e.g. a fibrous material layer is used as the second layer. Thus, when using such a composite material, it is not e.g. possible to produce a packaging container which is to be hermetically sealed by a deep drawing process. However, fibrous material layers, particularly cardboard, have the important advantage that they are made from a material which is not changed by electron radiation, whilst printing thereon is very easy.

It has been found that a container made solely from the aforementioned thermoplastic material or from such a multilayer plastic is unsuitable for use in an oven or the like. Thus, e.g. the rims of containers sealed in conjunction with an apparatus according to German patent application No. P 32 43 634.3 are influenced to such an extent by the heat action in the oven that they become wavy. This not only leads to an unattractive appearance of the container, but can also unfavourably influence the sealing between the sealing film or cover and the actual container.

The problem of the present invention is to develop a heat-resistant container of the aforementioned type, where the aforementioned disadvantages do not occur, which is particularly highly stable and remains stable and tight under heat action. Moreover, it must be possible to easily write or print thereon and it must be usable in an apparatus known from DE-OS Nos. 32 10 566 or 32 43 634.

According to the invention this problem is solved in that the tray is surrounded by a blank and the latter is at least partly joined to the tray.

As a result of this blank, the tray receives a support structure. According to the invention, the tray is shaped from a heat-resistant polyester or a thermoplastic material, e.g. polyethylene which, for increasing its resistance to thermal action, has been exposed to a high energy, electron or electromagnetic radiation and which is such that the thermoplastic layer in guaranteed manner is able to withstand a permanent thermal action of above 200° C. (oven temperature). Admittedly within certain limits heat-resistant polyester also withstands 200° C., but there are considerable temperature variations in an oven due to inadequate regulation.

In certain cases it can be sufficient if the blank is constituted by a base part and two side or end walls separated from the base part by bend or break lines, whereby said walls engage with an edge strip below the tray and are connected thereto. An even better result with regards to the container stability is obtained if both the end and side walls are provided with horizontally projecting edge strips, which in the position of use engage below the end rim of the tray, the edge strips of two facing walls being provided on either side with extensions. Thus, the blank or its edge strips form a closed frame on which rests the tray rim.

The edge strips are once again separated from the side or end walls by bend lines and are defined with respect to a base part by further bend lines.

This preferred embodiment permits a very easy manufacture of the blank and also the latter can be placed in the drawer known from DE-OS No. 32 10 566. Longitudinal slots in the bend lines improve the handling characteristics. After placing the blank in the drawer, the tray is also inserted and the sealing means are lowered onto the rim resting on the edge strips. Thus, if desired, sealing can take place with or without a sealing film or cover. It has been found that the edge strips of the blank have the effect of ensuring that the rim does not become wavy. This means that the container retains its desired original form, but is now provided with the blank as a support and carrier structure. There are no leaks in the case of a sealed-on film or cover.

The blank preferably comprises a fibrous material layer with an internal plastic coating. This internal plastic coating can on the one hand be readily connected to the thermoplastic layer of the rim during sealing on, whilst on the other hand the fibrous material layer is suitable for printing or writing on. As the blank is produced solely by bending along the bend lines, there is no distortion of the fibrous material layer with respect to the internal plastic coating, as was observed in the case of a container produced by deep drawing. As the internal plastic coating also does not come into contact with the content, it is unimportant whether or not it melts at the oven temperature, so that inexpensive, non-irradiated polyethylene hot melt or thermal lacquer can be used.

The fibrous material layer is preferably formed from cardboard or material containing recycled cellulose. As it is generally written or printed on or provided with a stick-on label or the like, there is no harm in using such waste material. As a result costs are kept much lower.

The statements made here regarding the blank material are only of an exemplified nature, because many other materials are equally suitable.

The tray can, as stated hereinbefore, be made entirely from a single layer of polyester or a crosslinked, thermoplastic material. Polyethylene is advantageous from the cost standpoint. However, it is more appropriate for strength reasons to use a composite material. In this case, the thermoplastic material should form the inner skin and the further layer the outer skin and between the two it is also possible to provide further layers. Preference is given to a very heat-resistant polystyrene outer skin. As stated hereinbefore, as required, the outer skin can also be formed by materials not modified by radiation or other thermoplastic materials.

If the container is now to be given a content which e.g. spoils easily, a film or cover, e.g. of cardboard can be sealed onto the tray. If the aforementioned sealing means are used, the film is sealed onto the tray rim and the blank edge strips.

The container is very inexpensively manufacturable in a highly stable and particularly dimensionally stable manner, because both the polyethylene used and the recycled fibrous layers used are inexpensive and its oxygen permeability is improved. No difficulties are encountered on printing on the blank. Even after spending a long time in the oven at oven temperature, there is no change to the container and in particular the content does not stick to the tray.

As a result of the planar sealing of the cover or foil, including in the marginal regions, the stability in this critical zone is ensured.

Further advantages, features and details of the invention can be gathered from the following description of preferred embodiments and with reference to the attached drawings, wherein show:

FIG. 1: A perspective view of a packing container according to the invention.

Figure 2:
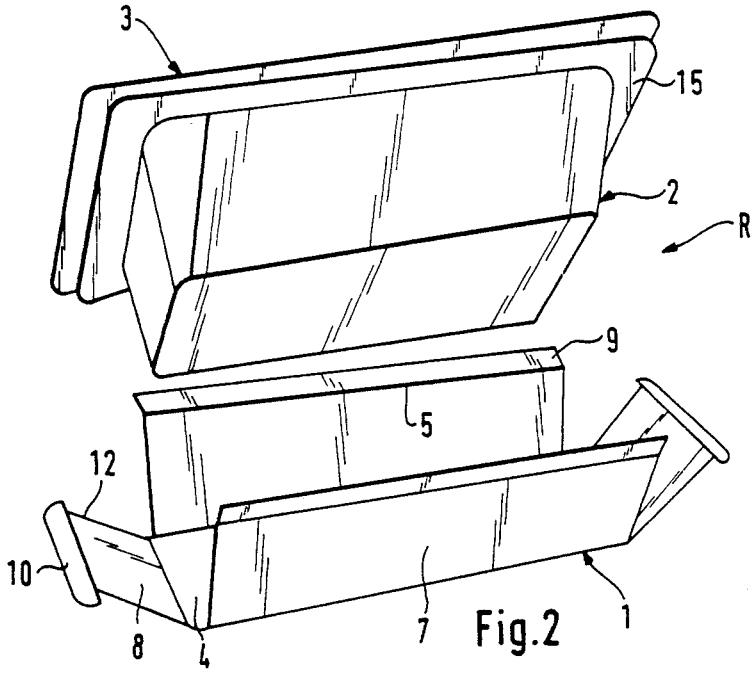

FIG. 2: A perspective view of a packing container according to FIG. 1 in exploded form.

Figure 3:
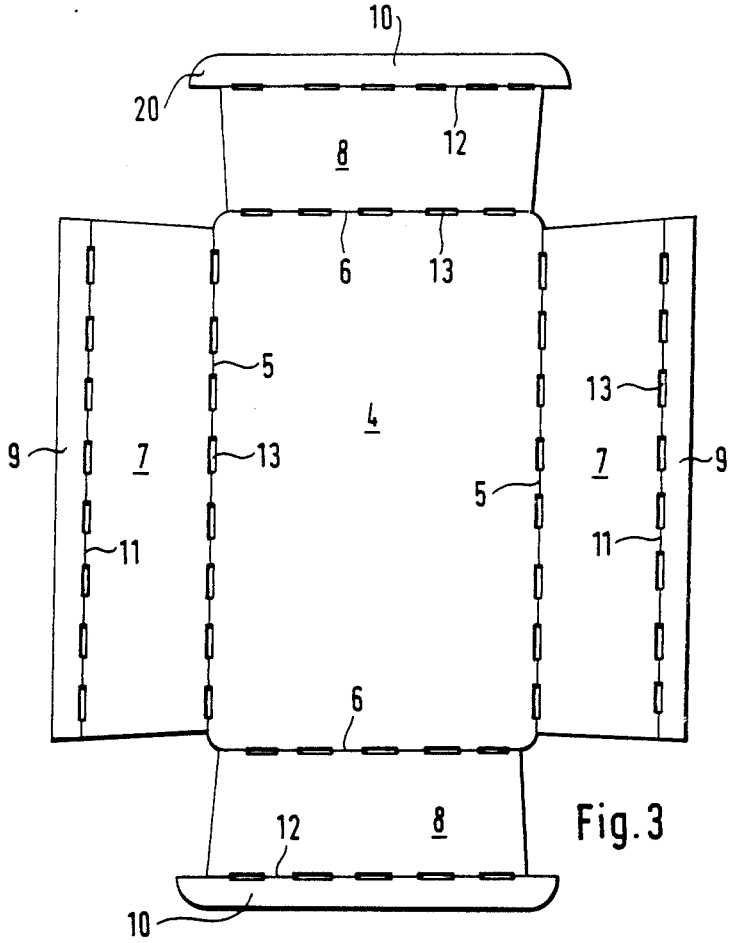

FIG. 3: A plan view of a blank of part of the packing container.

Figure 4:
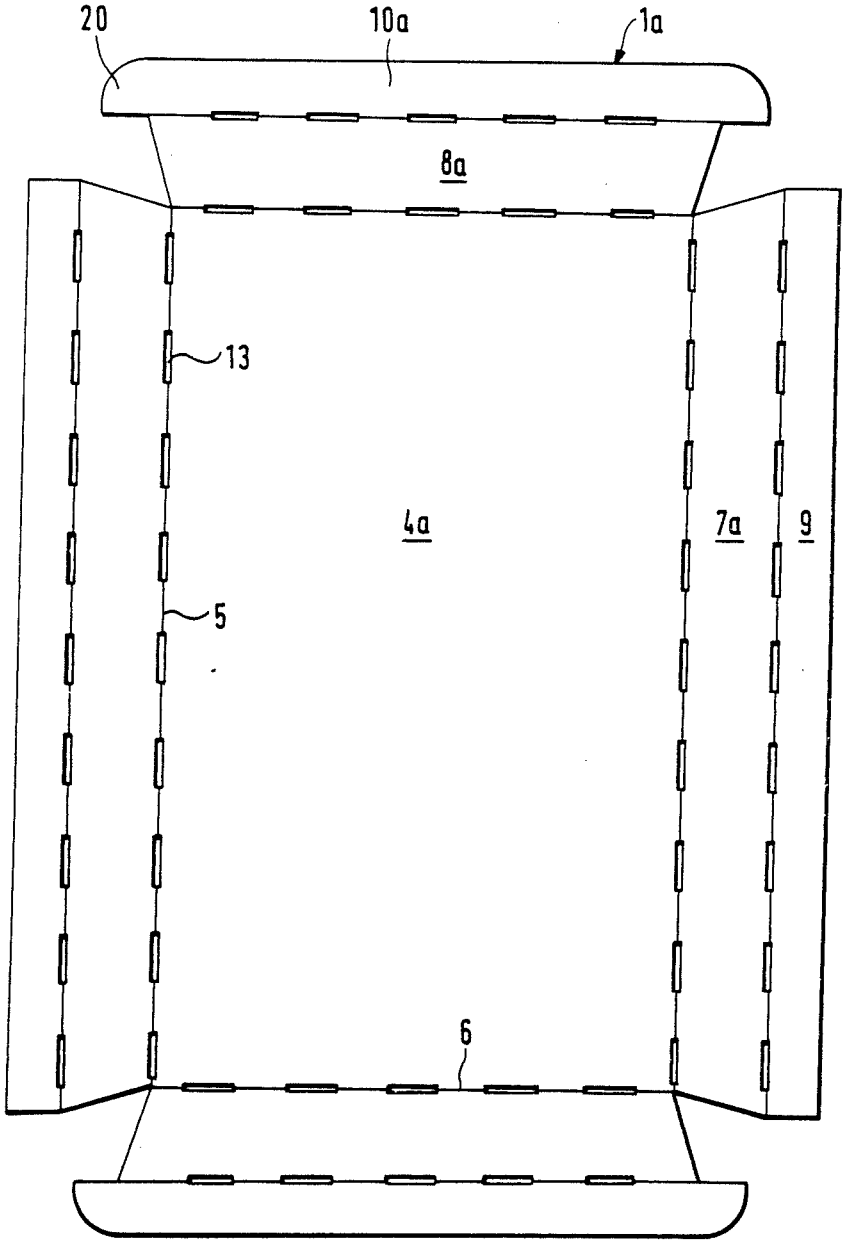

FIG. 4: A plan view of a further embodiment of a blank.

Figure 5:
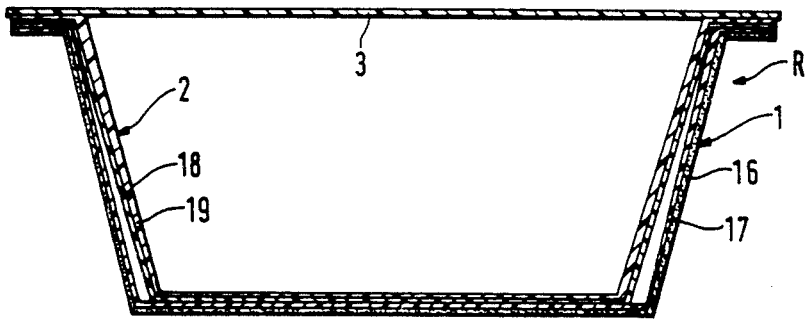

FIG. 5: A cross-section through the packing container along line IV—IV in FIG. 1.

According to FIGS. 1 and 2, a sealable packing container R comprises three parts, namely a cardboard blank 1, a tray 2 and a sealing film 3, the latter not being visible in FIG. 1.

According to FIG. 3, the cardboard blank 1 has a base part 4 and in each case a pair of side and end walls 7, 8 separated from the base part 4 by bend lines 5, 6. Edge strips 9, 10 are in each case separated by further bend lines 11, 12 from side and end walls 7, 8. In order to improve the bending along bend lines 5, 6, 11, 12, the latter are provided with longitudinal slots 13. The tray 2 is shaped in one piece from plastic and has an all-round rim.

The sealing film 3 is constituted by a commercially available sealable plastic film, but it is also possible to use any other sealable cover, such as e.g. cardboard or plastic-coated cardboard.

FIG. 5 shows the layered structure of the individual container parts 1, 2 and 3. Cardboard blank 1 comprises an outwardly directed fibrous material layer 16, which is coated with an internal plastic coating 17, preferably of polyethylene. Tray 2 has an outer skin 18 of a plastics material, preferably polystyrene and an inner skin 19 of a crosslinkable plastic, preferably polyethylene. The sealing film 3 is not formed from a composite material in the present embodiment.

Following the sealing process, rim 14 is not only joined to the sealing film 3 but also with the edge strips 9, 10 of cardboard blank 1. The remaining parts of cardboard blank 1 and tray 2 are not joined.

Cardboard blank 1 is particularly suitable to be placed in a drawer of a sealing machine of the type shown in DE-OS No. 32 10 566 or DE-OS No. 32 43 634. After placing tray 2 in the cardboard blank, the sealing film 3 is sealed on.

Blank 1*a* shown in FIG. 4, as a result of the wedge-shaped formation of the side or end wall 7, 8 and an overlapping zone 20, the edge strip 10*a* in the use position of a container, in which also the corner zones are closed.

I claim:

1. Container, particularly for receiving foods or the like and for use in a baking oven or the like comprising an inner tray surrounded by an outer tray, said inner tray being at least partially formed from a heat-resistant plastic material which has been exposed to a high energy, electron or electromagnetic radiation to increase its resistance to heat exposure and which is capable of permanently withstanding a temperature of over 200° C. (oven temperature), said outer tray being made of a blank (1) at least partly joined to the inner tray (2), said blank having an outer fibrous material layer (16) and an internal plastic coating (17) and comprising a base part (4) and a plurality of walls (7, 8) separated from said base part by means of bend lines (5 and/or 6), said walls having edge strips (9 and/or 10) which engage a first surface of a rim (14) on said inner tray (2), said edge strips being separated from the walls by means of additional bend lines (11 and/or 12), said container further being characterized by said edge strips of two facing ones of said walls carrying extensions (20), and a cover (3) sealed to a second surface of said rim opposed to said first surface.

2. Container according to claim 1, characterized in that the inner tray (2) further comprises a shaped heat-resistant polyester layer.

3. Container according to claim 1, characterized in that the inner tray (2) is shaped from polyethylene which has been exposed to said high energy, electron or electromagnetic radiation to increase its resistance to heat exposure and which is such that it can permanently withstand a temperature of over 200° C. (oven temperature).

4. Container according to claim 1, characterized in that the bend lines (5, 6 or 11, 12) have elongated slots (13).

5. Container according to claim 1, characterized in that the internal plastic coating (17) comprises an uncrosslinked or non-irradiated thermoplastic material, preferably polyethylene.

6. Container according to claim 1, characterized in that the fibrous layer (16) is produced from cardboard or material containing recycled cellulose.

7. Container according to claim 1, characterized in that the inner tray (2) is made from a composite material, whose inner skin (19) is formed from a heat-resistant plastic material which comprises at least one crosslinked, thermoplastic material.

8. Container according to claim 7, characterized in that the inner skin (19) is surrounded by an outer skin (18).

9. Container according to claim 8, characterized in that further layers are placed between said inner skin (19) and said outer skin (18).

10. Container according to claim 8, characterized in that the outer skin (18) is made from a heat-resistant material, which is not modified by irradiation.

11. Container according to claim 8, characterized in that the outer skin (18) is made from a heat-resistant material, which can also be modified by radiation.

12. Container according to claim 11, characterized in that the outer skin (18) is formed from polystyrene.

13. Container according to claim 1, characterized in that said cover sealing said inner tray (2) is formed by at least one of a film (3), cardboard, and plastic-coated cardboard.

14. Container according to claim 13, characterized in that said cover is sealed onto the rim (14) and the edge strips (9, 10).

15. Container according to claim 14, characterized in that said cover is formed by a film and the film (3) and edge strips (9, 10) are sealed to the rim (14) in one operation.

* * * * *